US008174461B1

(12) United States Patent
Smith

(10) Patent No.: US 8,174,461 B1
(45) Date of Patent: May 8, 2012

(54) ANTENNA MOUNTING SYSTEM AND METHOD

(75) Inventor: Robert Hyrum Smith, West Jordan, UT (US)

(73) Assignee: L-3 Communications, Corp., New York, NY (US)

( * ) Notice: Subject to any disclaimer, the term of this patent is extended or adjusted under 35 U.S.C. 154(b) by 689 days.

(21) Appl. No.: 12/328,692

(22) Filed: Dec. 4, 2008

(51) Int. Cl.
*H01Q 1/08* (2006.01)
*H01Q 1/12* (2006.01)
*H01Q 1/50* (2006.01)
*H01Q 1/32* (2006.01)

(52) U.S. Cl. ..... 343/881; 343/878; 343/880; 343/882; 343/885; 343/713

(58) Field of Classification Search ..... 343/878, 343/880, 881, 882, 885, 713
See application file for complete search history.

(56) References Cited

U.S. PATENT DOCUMENTS 2,860,342 A * 11/1958 Warnery ..... 343/881
3,263,232 A * 7/1966 Burwell et al. ..... 343/713
3,377,595 A * 4/1968 Carr et al. ..... 343/713
4,146,897 A * 3/1979 Wilson et al. ..... 343/882
4,185,288 A * 1/1980 Dosch et al. ..... 343/765
4,231,044 A * 10/1980 Henkel ..... 343/881
4,232,320 A * 11/1980 Savalle, Jr. ..... 343/765
4,309,708 A * 1/1982 Sayovitz ..... 343/713
4,404,565 A * 9/1983 Gurney et al. ..... 343/881
4,714,225 A 12/1987 Skinner et al.
4,868,578 A * 9/1989 Bruinsma et al. ..... 343/882
5,999,139 A 12/1999 Benjamin et al.
6,911,958 B2 6/2005 Swarup et al.
6,987,492 B1 1/2006 Buchanan et al.
7,852,274 B2 * 12/2010 Madden et al. ..... 343/713
2007/0095341 A1 * 5/2007 Kaneff ..... 126/601

* cited by examiner

*Primary Examiner* — Douglas W Owens
*Assistant Examiner* — Jennifer F Hu
(74) *Attorney, Agent, or Firm* — Kirton & McConkie; N. Kenneth Burraston

(57) ABSTRACT

A transportable directional antenna system includes an antenna pedestal, a plurality of outriggers, and an earth anchor. The earth anchor can be coupled to a horizontally centered point on the pedestal. Tension can be applied between the earth anchor and the pedestal to substantially preload the outriggers and the surface on which they bear to provide a highly stable antenna.

38 Claims, 5 Drawing Sheets

ANTENNA MOUNTING SYSTEM AND METHOD

FIELD

The present application relates to antennas. More particularly, the present application relates to a transportable antenna mounting system and method.

BACKGROUND

One component of radio communications systems in an antenna. Many systems use directional antennas, which must therefore be pointed in a desired direction to allow communications to be established. Increasingly, radio communications systems are using larger antennas to provide higher gain. Larger antennas, however, are more directional, and therefore must be pointed more accurately.

For a fixed size antenna, higher radio frequencies also correspond to higher directivity (narrower beamwidth). As communications systems migrate to higher frequencies, the resulting narrower beamwidth also creates a need for more accurate pointing.

In order to maintain accurate pointing, an antenna requires a stable mount. For antennas mounted in a fixed location and pointed in a fixed direction, providing a sufficiently stable mount is usually not a problem. For example, concrete foundations can be engineered to provide the desired amount of stability.

Transportable antennas, however, present a number of challenges. Maintaining accurate and stable pointing for a large antenna generally requires a large and stable mount for the antenna. It is generally not practical to provide highly stable concrete footings or other engineered foundations for a transportable antenna. Providing large and heavy mounting structure is also undesirable, as this represents additional weight and volume that is transported. Furthermore, a transportable antenna may be exposed to the elements (in contrast to a radome-protected fixed antenna), and therefore stability in wind and severe weather may also be needed. Accordingly, providing a stable mounting system for a large transportable antenna remains an unmet need.

SUMMARY

In some embodiments of the invention, a method of deploying a transportable, steerable, directional antenna assembly is provided. The method can include installing an earth anchor into a support surface and positioning the directional antenna assembly over the earth anchor. Another operation in the method can be deploying a plurality of outriggers. The outriggers can be positioned so that a first end of the outriggers is coupled to the directional antenna assembly and a second end of the outriggers bears on the support surface. The earth anchor can be coupled to the directional antenna at a coupling point vertically aligned with a point substantially centered between the first ends of the outriggers. Tension can be applied between the earth anchor and the coupling point to preload the outriggers and preload the supporting surface.

In some embodiments of the invention, a transportable directional antenna system is provided. The system can include a carrier and an antenna pedestal disposed on the carrier. The antenna pedestal is alternatively fixed to the carrier when in a transportation configuration and is decoupled from the carrier when in a deployed configuration. A steerable antenna assembly is moveably coupled to the antenna pedestal. A plurality of outriggers can be alternatively positioned in a transportation configuration and in a deployed position. In the deployed position, first ends of the outriggers are coupled to the antenna pedestal and second ends of the outriggers bear against a ground surface. A tensioning device is attachable to the earth anchor and to a horizontally centered point on the pedestal. When the earth anchor is installed into the ground surface, tension can be applied using the tensioning device to place preload force onto the outriggers and the ground surface.

In some embodiments of the invention, a highly stable transportable antenna mount is provided. The antenna mount can include an antenna pedestal and a plurality of outriggers. The outriggers can be moved between a transportation position and a deployed configuration. In the deployed position, first ends of the outriggers are coupled to the antenna pedestal and second ends of the outriggers bear against a ground surface. A tensioning device is attachable to the earth anchor and to a coupling point on the pedestal vertically aligned with a point substantially centered between the first ends of the outriggers. When the earth anchor is installed into the ground surface, tension can be applied using the tensioning device to place preload force onto the outriggers and the ground surface.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION

Figure 1A:
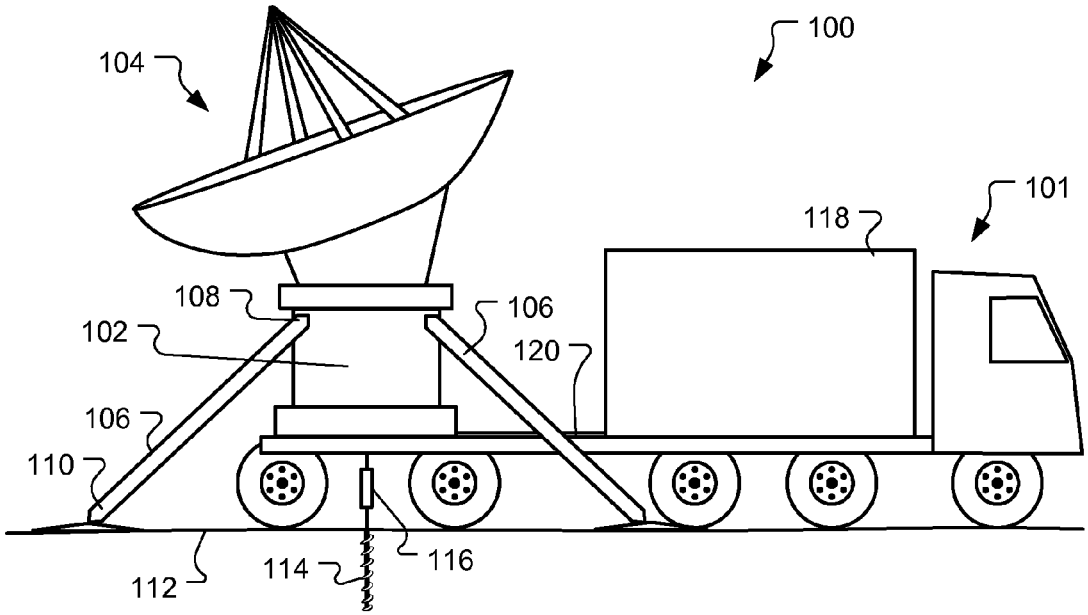
FIG. 1A is a side view illustration of a transportable directional antenna system in a deployed configuration in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to an antenna includes reference to one or more antennas.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also as including all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items.

As used herein the term "alternatively" refers to selection of one of two or more alternatives, and is not intended to limit the selection to only those listed alternatives.

Returning to the discussion introduced above in the background, providing a large, narrow beamwidth, transportable antenna can be particularly challenging. While deploying a transportable antenna may involve some minor site preparation, extensive excavation or concrete works are undesirable. In addition to the time spent performing site preparation, it is necessary to procure or transport any required construction materials, and thus it is preferable to minimize necessary site preparation.

A large antenna can present particularly difficult challenges. For example, for a steerable antenna, different loads can be placed on the antenna mounting structure depending on where the antenna is pointed. For example, an antenna pointed near the horizon presents different loads than an antenna pointed nearly overhead. While providing counter weights and other techniques to help balance the antenna can somewhat reduce these types of load changes, it is not possible to eliminate all load shifting on the antenna mount. Further, movement of the antenna can result in dynamic loads even when the antenna is well balanced over the mount. Compliance in the antenna mounting structure or compliance in the surface on which the antenna mounting structure sits can translate into shifts in the orientation of the antenna mounting structure as the antenna moves. Shifts in the orientation of the antenna mounting structure can translate directly into pointing errors.

Other factors can also cause the load on the antenna mounting structure to change. For example, a large antenna can have considerable surface area. Wind impinging on the antenna can therefore create additional loads on the antenna mounting structure. The loads will vary with wind speed and orientation, and thus can be highly variable and significant.

While it is desirable to provide a very stiff antenna mounting structure to overcome these challenged, stiffness generally requires very large structural members. Moreover, even a very stiff antenna mounting structure will fail to maintain proper orientation if it is deployed on a compliant ground surface. Accordingly, it has been recognized by the present inventor that alternate techniques for achieving a highly stable antenna mount are necessary in the context of a transportable antenna, especially where differing types of soil conditions may be encountered in deployments of the transportable antenna.

Figure 1B:
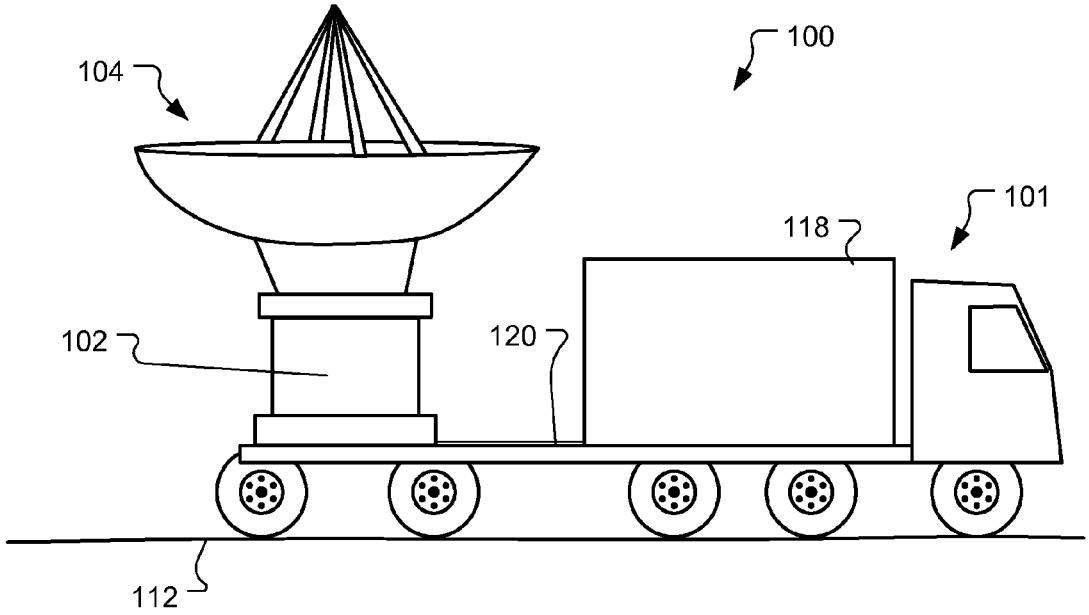
FIG. 1B is a side view illustration of the transportable directional antenna system of FIG. 1A in a transportation configuration.

FIG. 1A illustrates a transportable directional antenna system in a deployed configuration in accordance with some embodiments of the present invention. The system 100 can include a carrier 101, which can be used for transporting the transportable antenna. For example, the carrier can be a detachable trailer, a tractor-trailer, or a truck. An antenna pedestal 102 can be disposed on the carrier, and a steerable antenna assembly 104 can be coupled to the pedestal. The steerable antenna assembly can include a large reflector (e.g., a parabolic dish), such as a reflector 5 meters in diameter or larger. In a transportation configuration, as shown in FIG. 1B, the antenna pedestal can be fixed to the carrier (e.g., bolted to the carrier as described further below). In the deployed configuration, the antenna pedestal can be decoupled from the carrier (e.g., unbolted as described further below).

A plurality of outriggers 106 can provide stabilization of the antenna pedestal as will be described in further detail below. In the deployed configuration (as shown in FIG. 1A), the outriggers can be coupled to the antenna pedestal at a first end 108 and bear against the ground surface 112 at the second end 110. For transportation, the outriggers can be removable for storage in or on the carrier 101 (as shown in FIG. 1B). Alternatively, the outriggers can be capable of being folded up for transportation.

The system 100 can also include an earth anchor 114, which can be coupled to the antenna pedestal 102 via a tensioning device 116 when deployed. The coupling to the antenna pedestal can be at a point substantially horizontally centered on the antenna pedestal (e.g., a point vertically aligned with a point substantially centered between the first ends 108 of the outriggers 106). The earth anchor can be set into the ground, and the tensioning device can be used to apply load to the antenna pedestal (e.g., as described further below). For transportation, the tensioning device and earth anchor can be removed and stowed in or on the carrier. If desired, the system can include a number of earth anchors, wherein an earth anchor is used each time the system is deployed and left behind after use, thereby avoiding any need to remove the earth anchor.

Also disposed on the truck can be communications equipment (not shown), for example, disposed in a shelter 118. The antenna pedestal 102 and steerable antenna assembly 104 can be electrically connected to the communications equipment in the shelter via cables and/or waveguides 120. The cables and/or waveguides can remain connected when transitioning between the transportation configuration and the deployed configuration.

The tensioning device 116 allows considerable downward preloading to be applied to the antenna pedestal 102 and the outriggers 106. In particular, the downward loading can be many times higher than that provided by the weight of the antenna pedestal and steerable antenna assembly 104 alone. The tensioning device and earth anchor allow considerable preload force to be applied without requiring heavy weights to be carried with the system. This helps to keep the overall weight of the system lower.

When deployed, the application of high preload force helps to improve stabilization of the antenna pedestal 102 in several ways. Without the preload force, shifts in load applied to the antenna pedestal (e.g., from movement of the steerable antenna assembly 104 or wind loading) could result in portions of the mounting structure alternately being in compression load or tension load. This could result in backlash that degrades pointing accuracy. By applying sufficient tension between the pedestal 102 and the earth anchor 114, however, preload forces in the various structural elements of the antenna mount (e.g., outriggers 106) can be substantially greater than the variable loads anticipated, helping to ensure that structural members are constantly in tension or compression, in turn reducing or eliminating any backlash.

Shifts in load can also result in movement if the ground surface 112 has a sufficient degree of compliance. Since virtually all soil conditions provide some amount of spring like behavior under lower loads, applying sufficient preload forces to the outriggers 106 can help to sufficiently preload the ground surface 112 sufficient to reduce the spring like behavior of the ground surface.

The tension applied from the tensioning device 116 is applied in a substantially centered manner to the antenna pedestal 102, and hence the outriggers 106. Accordingly, the preload force will be substantially equally applied to each of the outriggers. This helps to ensure that the outriggers have a consistent, predefined, level of preload developed, helping to reduce any movement of the antenna pedestal due to load shifts. In contrast, while providing separate anchors and tensioning devices for each outrigger would allow lower force to be applied by each tension device, it would be more difficult to ensure equal preload force in each of the outriggers. Accordingly, use of a single tensioning device applying force at or near the center of the pedestal makes deployment of the system 100 simpler and less error prone.

The preload applied can be substantially greater than the total weight of the transportable directional antenna system. For example, the tension force can be at least two times greater, three times greater, or five times greater than the total weight of the transportable directional antenna system. Accordingly, instead of carrying a large amount of dead weight to provide adequate preload forces to stabilize the antenna, a relatively lightweight tension device can be used to provide much higher preload forces than possible by using dead weight alone.

In general, the tensioning device 116 can include a connecting member and a tightener. The tightener can be, for example, a turnbuckle, a come-along, a chain tightener, a winch, or like devices. The connecting member can be a chain, a steel cable, a para-aramid cable (e.g., Kevlar fiber), or the like.

The tensioning device can include a tension measurement gauge to help an operator ensure that sufficient tension force has been applied. Alternately, a load measurement gauge can be coupled to one or more of the outriggers to measure load (e.g., compression or tension) within the outrigger.

As a particular example, analysis of a 5-meter diameter antenna system has been performed to determine required preload force to maintain spatial orientation of the pedestal portion when outriggers were positioned extending out about 5 feet each from a 4 foot diameter pedestal. Stability of at least 0.05 degrees over the full range of motion of the reflector and in wind gusts up to 60 mph was desired. A preload force of about 70,000 pounds was found to be sufficient, even in soil conditions of clay, sand, gravel, and combinations thereof. More particularly, operation in soil types of clays and silts (CL, CH, ML, MH), sands (SM, SC, SP, SW), and gravels (GM, GC, GP, GW) in accordance with the Unified Soil Classification System can be provided.

In contrast, the weight of the entire system (including communications systems, carrier, shelter, etc.) for a 5-meter antenna configuration is estimated to be about 45,000 pounds, of which the weight of the antenna and mount (e.g., pedestal 102, outriggers 106, and antenna assembly 104) is only about 12,000 pounds. Thus, the preload force applied is greater than three times the weight of the antenna and mount. The preload force is also greater than the weight of the entire system (which cannot practically be used to help stabilize the antenna). For example, decoupling the antenna from the carrier is believed to be more beneficial than attempting to use the weight of the carrier to stiffen and stabilize the antenna mount, because the carrier is also subject to load shifts and movement due to wind. Accordingly, using passive weight to provide sufficient downward preloading force would require substantially increasing the overall weight of the system.

Figure 2A:
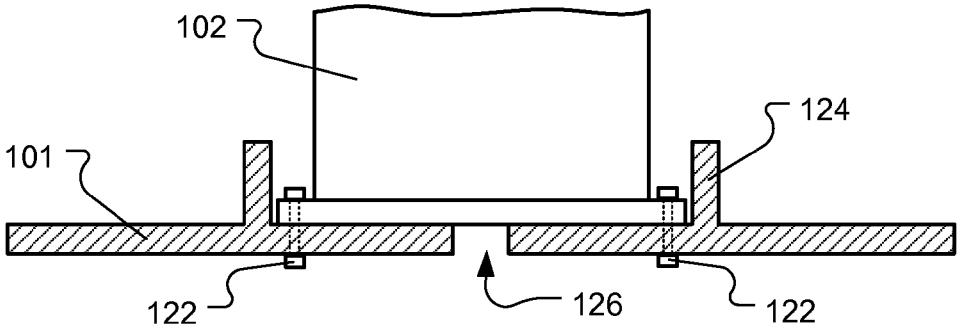
FIG. 2A is a detailed side cross section view illustration of the interface between the antenna pedestal and the carrier for the configuration of FIG. 1B, in accordance with some embodiments of the present invention.
Figure 2B:
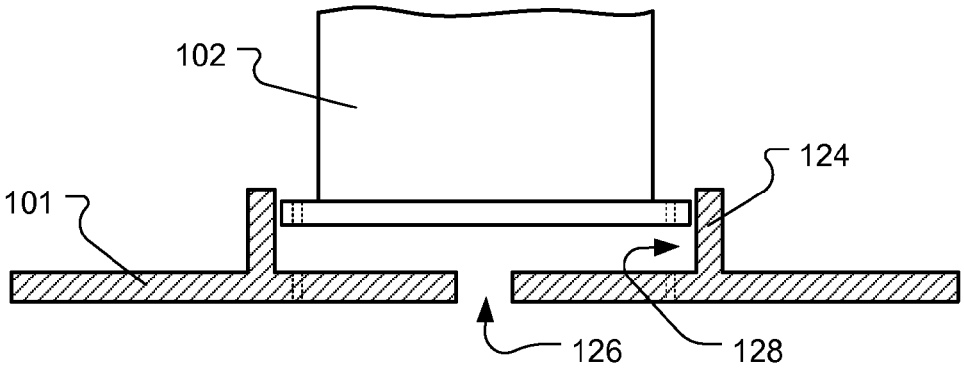
FIG. 2B is a detailed side cross section view illustration of the interface between the antenna pedestal and the carrier for the configuration of FIG. 1A, in accordance with some embodiments of the present invention.

FIGS. 2A and 2B provide detailed illustrations of the interface between the antenna pedestal 102 and the carrier 101 in accordance with some embodiments of the invention. In FIG. 2A the pedestal is shown in a transportation configuration. Bolts 122 secure the antenna pedestal to carrier. When deployed, as shown in FIG. 2B, the bolts are removed, and the antenna pedestal is decoupled from the carrier. Accordingly, the antenna pedestal can move in an upward and downward direction and tilt as necessary to be leveled. The antenna can be supported above the bed of the carrier 101 by the outriggers when fully deployed. Decoupling the antenna pedestal from the carrier can help to improve stability, as vibration, wind load, and other loading changes from the carrier are not mechanically transmitted to the antenna. A hole 126 or open area in the carrier can be provided to allow access to the underside of the antenna pedestal for connection to the tensioning device 116.

If desired, a pinch shield 124 can be arranged to cover the gap 128 between the antenna pedestal 102 and the carrier 101 when in the deployed configuration. This can help to avoid pinching of fingers when transitioning between the deployed and transportation configurations. While the pinch shield is shown here as attached to the carrier and extending upwards to cover the gap, alternatively the pinch shield can be attached to the antenna pedestal and extend downward to cover the gap.

Figure 3A:
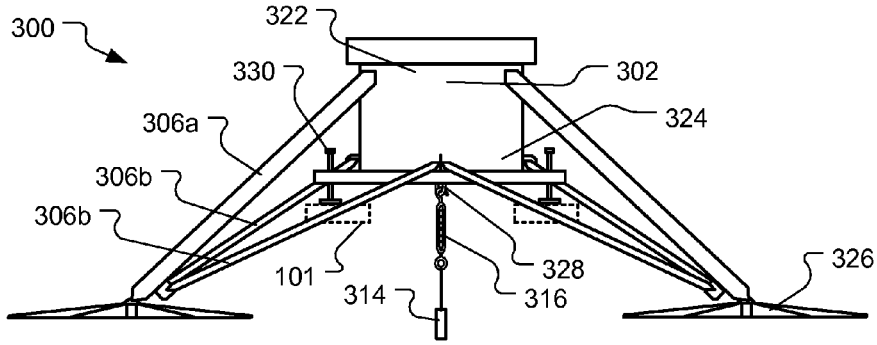
FIG. 3A is a side view illustration of an antenna mount system in accordance with some embodiments of the present invention.
Figure 3B:
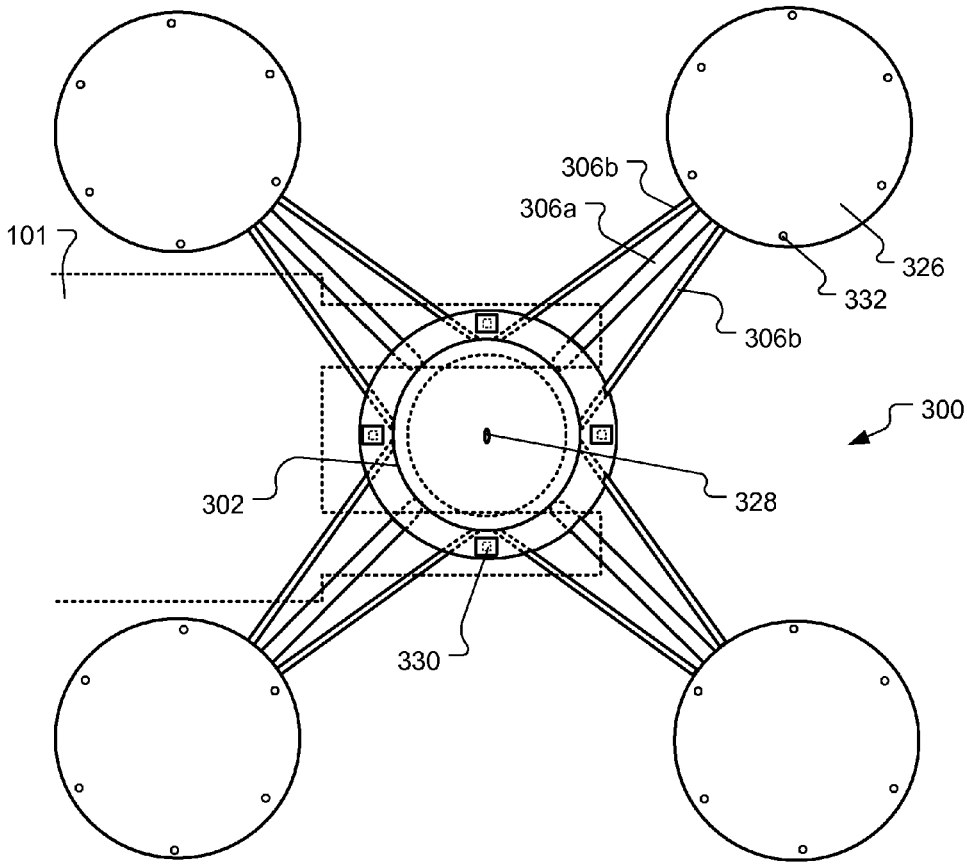
FIG. 3B is a bottom view illustration of the antenna mount system of FIG. 3A.

FIG. 3 illustrates an antenna mount system 300 in further detail in accordance with some embodiments of the invention. The antenna mount system can, for example, be used in a transportable directional antenna system as described above.

The antenna mount system includes an antenna pedestal 302 and a plurality of outriggers. The outriggers can include a compression member 306*a* attached to an upper portion 322 of the antenna pedestal and tension members 306*b* attached to a lower portion 324 of the antenna pedestal. Although one compression member is shown here, two or more compression members can be used. Similarly, although two tension members are shown here, a single tension member or more than two tension members can be used. The antenna mount system 300 can also include other structural members, for example, braces (not shown) between the outriggers. The outriggers can also include a flared portion 326 at the ground interface end. Holes 332 can be provided in the flared portion to allow for spikes or the like to be driven into the ground surface to provide additional stability. While four outriggers are shown here, the antenna mount system can include three or more than four outriggers if desired.

A loop 328 at the bottom of the pedestal provides an attachment point for attachment of a tensioning device 316, which in turn attaches to an earth anchor 314. The tensioning device can allow sufficient tension force to be applied to stabilize the antenna mounting system 300 in similar manners as described above. For example, the tension force can exceed three or five times the total weight of the antenna mount system, providing a much greater stabilizing force that would be possible using the dead weight of the antenna mounting system itself.

The antenna mount system 300 can include leveling jacks 330. The leveling jacks can be used to initially level the antenna pedestal to assist in placement of the flared portions 326 of the outriggers. The leveling jacks can bear on the ground, or alternatively the leveling jacks can bear on a carrier 101 used to transport the antenna mount system 300.

Figure 4:
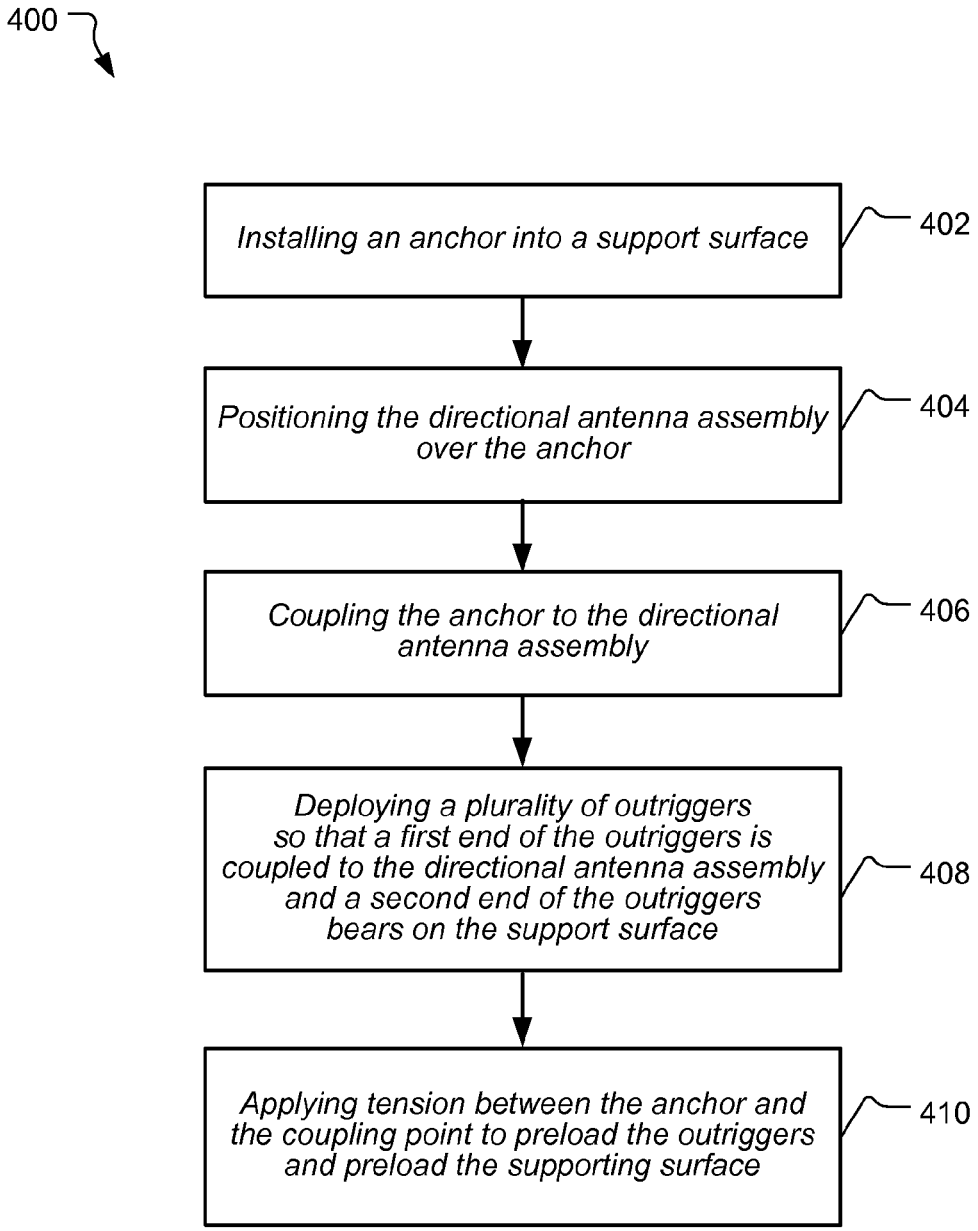
FIG. 4 is a flow chart of a method of deploying a transportable steerable directional antenna assembly in accordance with some embodiments of the present invention.

FIG. 4 illustrates a flow chart of a method of deploying a transportable steerable directional antenna assembly in accordance with some embodiments of the present invention. The method, shown generally at 400, can include installing 402 an anchor into a support surface. For example, the anchor can be installed into a hole drilled into the support surface. As another example, the anchor can be screwed into the support surface. The method can also include positioning 404 the antenna assembly over the anchor and coupling 406 the anchor to the directional antenna assembly. For example, the antenna can be carried by a carrier and positioning the antenna can include moving the carrier into position over the anchor. For example, the carrier can be towed or pushed into position.

Once the antenna assembly is positioned over the anchor, another operation can be deploying 408 a plurality of outriggers so that a first end of the outriggers is coupled to the directional antenna assembly and a second end of the outriggers bears on the support surface. For example, first ends of the outriggers can be coupled to a pedestal portion of the directional antenna assembly. The antenna can also mechanically isolated from the carrier, for example, by unbolting the antenna from the carrier. The antenna can also be leveled using leveling jacks.

While extensive site preparations are not necessary, it can be helpful to perform some minor surface preparation before deploying the antenna. For example, soft organic materials and/or top soil can be removed from the area where the outriggers are to be deployed.

Another operation can be applying 410 tension between the anchor and the coupling point to preload the outriggers and preload the supporting surface. For example, tension can be applied with a winch, turnbuckle, come-along, chain tightener, or similar device. The applied tension can be at least two times the total weight of the directional assembly, or more particularly three times the total weight, or even more particularly five times the total weight. The anchor can be coupled to a coupling point vertically aligned with a point substantially centered between the ends of the outriggers. Thus, the tension can result in substantially equal preload force being applied to each outrigger.

Other arrangements of the operations can be used in some embodiments. For example, the carrier can include equipment to allow the anchor to be installed into the support surface after the carrier is positioned at a desired location, in which case operation 404 and operation 402 can be reversed in order.

Figure 5:
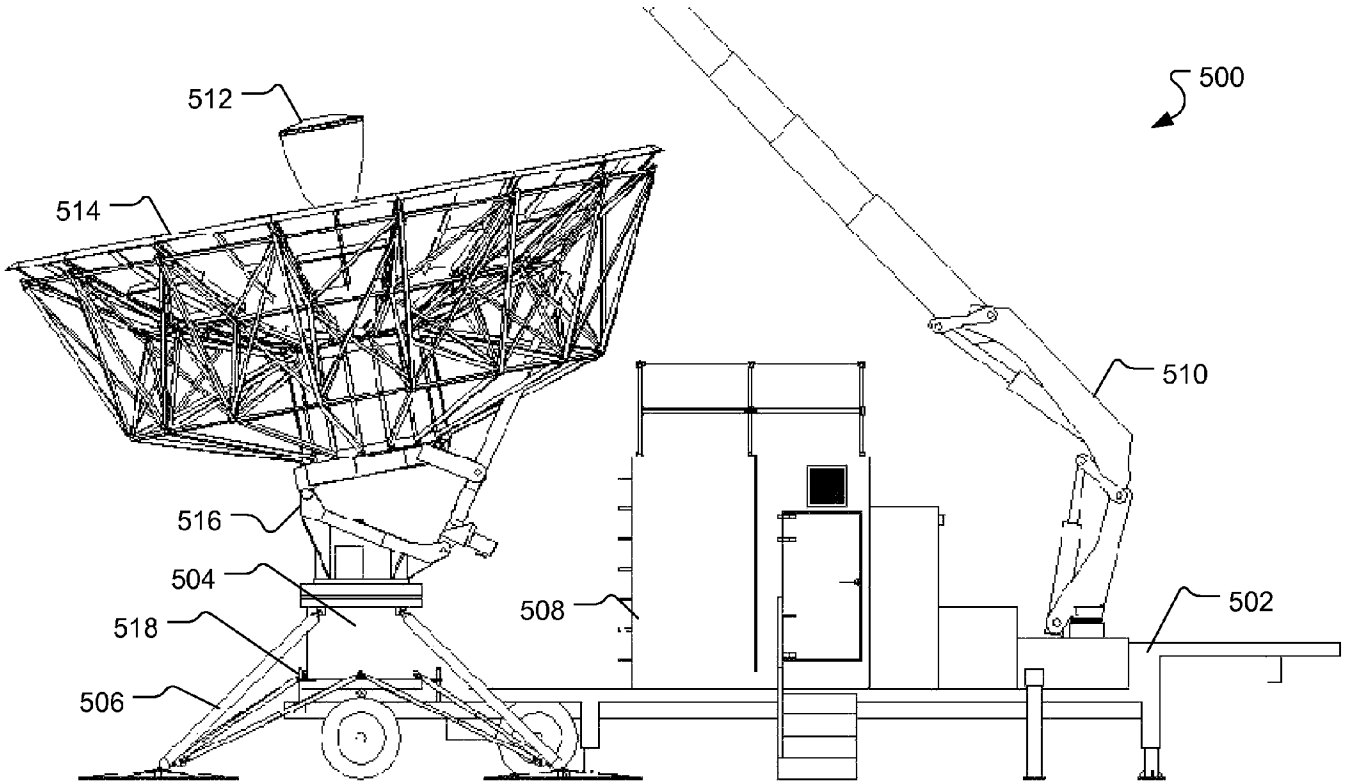
FIG. 5 is a side view illustration of another transportable directional antenna system in accordance with some embodiments of the present invention.

FIG. 5 provides an illustration of another embodiment of a transportable antenna system shown in a deployed configuration. The system 500 can include a trailer bed 502, on which the various portions of the system are mounted or positioned for transportation, including an antenna pedestal 504, equipment shelter 508, and crane 510. The antenna pedestal 504 can have attached outriggers 506, for example as described as above. The antenna can include a feed 512, reflector 514, and positioning assembly 516.

For very large antennas, the antenna may be partially disassembled for transport, and the crane can be used to help assemble and disassemble the antenna. For example, the antenna feed 512, portions of the reflector 514 (e.g., trusses and/or panels), and/or positioning assembly 516 (or portions thereof) may be removable for stowage on the trailer 502 during transportation.

Deployment of the system 500 can proceed as follows. A ground anchor (not shown) can be driven into the ground in the desired location, for example using a jack hammer (not shown), drill (not shown), and/or the crane 510 in conjunction with a driver attachment (not shown). The trailer 502 can then be pulled over the anchor location to position the pedestal 504 roughly centered over the anchor position (e.g., within about 3 inches horizontally). The pedestal can be attached to the anchor with a winch assembly (not shown). The bottom of the pedestal can then be detached from the trailer (e.g., by unbolting, as described above) and lifted using leveling jacks 518 (e.g., lifted about 3 inches off the trailer or sufficient distance so that the pedestal remains off the trailer even when preload tension is applied by the winch assembly). The outriggers 506 can then be deployed and adjusted until each outrigger begins to support some of the pedestal weight. The lifting jacks can then be raised so that the outriggers carry the full load. The winch assembly can then be tightened to apply a first preload force (e.g., about 10,000 pounds) between the anchor and the pedestal.

The antenna system can then be assembled, using the crane 510 to help move the feed 512, components of reflector 514 (e.g., trusses and panels), and directional assembly 516 into position. Access to the antenna can be facilitated by standing on the equipment shelter 508. Any necessary cable connections can also be made to interface the antenna to communications equipment disposed in the equipment shelter.

Once the antenna system has been assembled, additional tension can be applied using the winch assembly to increase the tension between the anchor and the pedestal 504 to a second preload force (e.g., about 50,000 pounds). Movement of the antenna can then be performed.

Summarizing and reiterating to some extent, a highly stable transportable antenna mount has been developed. The system makes uses of an earth anchor and tensioning device to develop high preload forces on components of the antenna mount by pulling down from a central position on the antenna mount. The antenna mount can be arranged so that key supporting structural elements are preloaded in either tension or compression to provide very high stiffness. By using preloading, lower weight components can be used while maintaining a desired degree of stiffness. The preloading also helps to reduce backlash and non-linearities (due to friction or slop), in turn reducing deflection in the mount. The antenna mount can be transported by a carrier, yet easily decoupled from the carrier by removing a small number of bolts to help reduce mechanical transmission of vibration and load changes from the carrier into the antenna mount. The transportable antenna mount is suitable for use with very large antennas (e.g., 5 meters and greater) having very narrow beamwidths (e.g., 0.1 degrees and smaller).

While a number of illustrative applications have been described, many other applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts of the invention as set forth in the claims.

The invention claimed is:

1. A method of deploying a transportable, steerable, directional antenna assembly, comprising:

installing an earth anchor into a support surface;

positioning the directional antenna assembly over the earth anchor;

deploying a plurality of outriggers into a deployed position in which a first end of each of the outriggers is coupled to the directional antenna assembly and a second end of each of the outriggers bears on the support surface;

coupling the anchor to the directional antenna assembly at a coupling point vertically aligned with a point substantially centered among all of the plurality of outriggers in the deployed position; and applying tension between the anchor and the coupling point to preload the outriggers and preload the supporting surface.

2. The method of claim 1, wherein the applying tension further comprises applying tension sufficient to preload each of the outriggers with a preload force substantially greater than a total weight of the directional antenna assembly.

3. The method of claim 2, wherein the preload force is at least two times the total weight of the directional assembly.

4. The method of claim 3, wherein the preload force is at least three times the total weight of the directional assembly.

5. The method of claim 1, wherein the applying tension further comprises applying sufficient tension so that a substantially equal preload force is applied to each outrigger.

6. The method of claim 1, wherein the deploying the plurality of outriggers comprises coupling the first end of the outriggers to a pedestal portion of the directional assembly.

7. The method of claim 6, further comprising leveling the pedestal portion.

8. The method of claim 1, wherein the directional antenna assembly comprises a steerable reflector at least 5 meters in diameter coupled to a pedestal portion, and wherein applying tension comprises applying sufficient preload so that the pedestal portion maintains a constant spatial orientation within an accuracy of 0.2 degrees over a full range of motion of the steerable reflector.

9. The method of claim 8, wherein applying tension further comprises applying sufficient preload so that the pedestal portion maintains a constant spatial orientation with an accuracy of at least 0.2 degrees in winds up to 60 miles per hour.

10. The method of claim 8, wherein the support surface comprises clay, sand, gravel, and combinations thereof.

11. The method of claim 1, wherein the point with which the coupling point on the directional antenna assembly is vertically aligned is substantially centered horizontally between the first ends of all of the outriggers in the deployed position.

12. The method of claim 1, wherein the installing an earth anchor comprises:

drilling a hole into the support surface, and installing the earth anchor into the hole; and wherein the positioning the directional antenna assembly over the earth anchor comprises:

moving a carrier into position over the hole, wherein the directional antenna assembly is carried by the carrier.

13. A transportable directional antenna system, comprising:

a carrier;

an antenna pedestal disposed on the carrier, the antenna pedestal being alternatively fixed to the carrier in a transportation configuration and decoupled from the carrier in a deployed configuration;

a steerable antenna assembly moveably coupled to the antenna pedestal;

a plurality of outriggers each comprising a first end and a second end, the outriggers being positionable into a transportation position, and being positionable into a deployed position wherein the first ends are coupled to the antenna pedestal and the second ends bear against a ground surface;

an earth anchor; and a tensioning device attachable to the earth anchor and to a horizontally centered point on the pedestal.

14. The system of claim 13, wherein the horizontally centered point is vertically aligned with a point substantially centered between the first ends of the outriggers.

15. The system of claim 13, wherein the tension device comprises a connecting member and a tightener.

16. The system of claim 13, wherein the tension device further comprises a tension measurement gauge.

17. The system of claim 13, wherein the system further comprises a load measurement gauge coupled to at least one of the plurality of outriggers to measure load within the outrigger.

18. The system of claim 13, wherein the tensioning device is configured to apply a tension force substantially greater than a total weight of the transportable directional antenna system.

19. The system of claim 18, wherein the tension force is at least three times a total weight of the transportable directional antenna system.

20. The system of claim 13, wherein the antenna pedestal is bolted to the carrier when in the transportation configuration.

21. The system of claim 13, wherein the antenna pedestal is suspended above a portion of carrier when in the deployed configuration.

22. The system of claim 13, further comprises a plurality of leveling jacks coupled to the antenna pedestal.

23. The system of claim 22, wherein the leveling jacks bear on the carrier.

24. The system of claim 22, wherein the leveling jacks bear on the ground surface.

25. The system of claim 13, wherein the steerable antenna assembly comprises a reflector at least 5 meters in diameter.

26. The system of claim 25, wherein the tensioning device tension is capable of applying sufficient tension force so that the pedestal portion maintains a spatial orientation with an accuracy of at least 0.05 degrees over a full range of motion of the reflector.

27. The system of claim 13, wherein the outriggers each comprise a compression member configured to be coupled to the antenna pedestal at an upper portion of the antenna pedestal and a tension member configured to be coupled to the antenna pedestal at a lower portion of the antenna pedestal.

28. The system of claim 13, wherein the outriggers each comprise a flared portion at the second end.

29. The system of claim 13, further comprising a pinch shield cover a gap between the antenna pedestal and the carrier when the antenna pedestal is in the deployed position.

30. The system of claim 13, further comprising electrical connections connected between the antenna pedestal and the carrier, wherein the electrical connections remain connected when transitioning between the transportation configuration and the deployed configuration.

31. The system of claim 13, further comprising at least four outriggers.

32. A highly stable transportable antenna mount system comprising:

an antenna pedestal;

a plurality of outriggers each comprising a first end and a second end, the outriggers being moveable into a transportation position and being moveable into a deployed position wherein the first ends are coupled to the pedestal and the second ends are positioned against a ground surface;

an earth anchor; and a tensioning device attachable to the earth anchor and to a coupling point on the pedestal vertically aligned with a point substantially centered among the first ends of all of the outriggers in the deployed position.

33. The system of claim 32, wherein the tension device is configured to apply a tension force substantially greater than at least three times the total weight of the system.

34. The system of claim 33, wherein the tension force is at least five times the weight of the system.

35. The system of claim 33, wherein said antenna pedestal is attachable to and detachable from a carrier for transporting the antenna pedestal.

36. The system of claim 33, wherein the point with which the coupling point on the pedestal is vertically aligned is substantially centered horizontally between the first ends of all of the outriggers in the deployed position.

37. A method of deploying a transportable, steerable, directional antenna assembly, comprising:

installing an earth anchor into a support surface;

positioning the directional antenna assembly over the earth anchor;

deploying a plurality of outriggers so that a first end of the outriggers is coupled to the directional antenna assembly and a second end of the outriggers bears on the support surface;

coupling the anchor to the directional antenna assembly at a coupling point vertically aligned with a point substantially centered between the plurality of outriggers; and applying tension between the anchor and the coupling point to preload the outriggers and preload the supporting surface, wherein the installing an earth anchor comprises:

drilling a hole into the support surface, and installing the earth anchor into the hole; and wherein the positioning the directional antenna assembly over the earth anchor comprises:

moving a carrier into position over the hole, wherein the directional antenna assembly is carried by the carrier.

38. The method of claim 37, further comprising mechanically isolating the directional antenna assembly from the carrier.

* * * * *